United States Patent [19]

Baier et al.

[11] Patent Number: 4,511,873

[45] Date of Patent: Apr. 16, 1985

[54] CURRENT TRANSFORMER INSULATED BY PRESSURIZED GAS

[75] Inventors: Manfred Baier, Oberehrendigen; Andreas Tobler, Lengnau, both of Switzerland

[73] Assignee: BBC Brown, Boveri & Company, Limited, Baden, Switzerland

[21] Appl. No.: 511,942

[22] Filed: Jul. 8, 1983

[30] Foreign Application Priority Data

Jul. 19, 1982 [CH] Switzerland ..... 4392/82

[51] Int. Cl.[3] ..... H01F 27/02

[52] U.S. Cl. ..... 336/90; 336/62; 336/92; 174/17 GF

[58] Field of Search ..... 336/90, 92, 61, 62, 336/179, 180, 185, 208; 174/17 GF; 323/358

[56] References Cited

U.S. PATENT DOCUMENTS

| | | | |
|---|---|---|---|
| 2,160,660 | 5/1939 | Hobart | 174/17 GF |
| 3,281,521 | 10/1966 | Wilson | 174/17 GF |
| 4,204,084 | 5/1980 | Mastroianni et al. | 174/17 GF X |
| 4,237,333 | 12/1980 | Classon | 174/17 GF X |
| 4,251,682 | 2/1981 | Ebert et al. | 174/17 GF X |

OTHER PUBLICATIONS

"Gaseous Insulation for High Voltage Transformers" G. Camilli et al., AIEE Technical Paper 52-78, Dec. 1951.

*Primary Examiner*—A. D. Pellinen
*Assistant Examiner*—Susan A. Steward
*Attorney, Agent, or Firm*—Burns, Doane, Swecker & Mathis

[57] ABSTRACT

A current transformer for outdoor high-voltage installations which is insulated by pressurized gas includes a metallic top housing mounted to a hollow porcelain insulator. The top housing contains a primary conductor which is surrounded by coils of the secondary circuit. The secondary terminal leads are installed in a grounded lead-through tube which is disposed within the hollow porcelain insulator. In order to increase the dielectric strength of the current transformer, the space which is enclosed by the top housing and the porcelain insulator is divided into a high-pressure region and a low-pressure region, the former region including zones which are exposed to high voltages, in particular the interior of the top housing, and which are bounded throughout by metal and a mechanically strong insulating material, such as a casting region. The partition between the high-pressure region and the low-pressure region preferably is a conical sleeve which surrounds the lead-through tube in the upper portion of the porcelain insulator.

5 Claims, 2 Drawing Figures

CURRENT TRANSFORMER INSULATED BY PRESSURIZED GAS

FIELD OF THE INVENTION

The invention relates to current transformers insulated by pressurized gas, and particularly to such transformers for use in outdoor high-voltage installations.

BACKGROUND OF THE INVENTION

A current transformer of the above-mentioned type has been disclosed, for example, in U.S. Pat. No. 3,380,809. In the known current transformers of this type, the entire space inside a hollow procelain insulator is in communication with the interior of a top housing for the primary conductor and the coils of the secondary circuit. As a result, the pressure of the insulating gas, which separates the secondary coils and a lead-through tube for the secondary circuit terminal leads from the primary conductor and from the top housing, which also carries a high voltage, acts also on the procelain insulator. Due to its comparatively low mechanical strength, the insulator constitutes the limiting factor for the permissible gas pressure. In order to increase the permissible gas pressure, and hence the dielectric strength of the gas and the voltage which can be applied to the current transformers of the aforementioned type, the top housing and the procelain insulator are braced. However, apart from achieving only a slight increase in the permissible gas pressure, this approach is susceptible to problems arising from the dissimilar thermal expansion exhibited by the insulator and the lead through.

SUMMARY OF THE INVENTION

Accordingly, it is a principal object of the present invention to provide an improved current transformer which can withstand considerably high voltages, even under operating conditions which have made such higher voltages difficult in the past, while at the same time retaining essentially the same outside dimensions of prior transformers.

This and other objects are achieved in accordance with the present invention by providing a gas-tight partition connected to the top housing of the current transformer for forming a high-pressure gas region encompassing the primary conductor and the secondary coils and a low-pressure gas region defined at least in part by the insulator. Preferably, the partition comprises a conical sleeve coaxially surrounding a portion of the lead-through tube and extending into the interior of the insulator. Advantageously, the sleeve comprises a metallic upper portion and an insulating lower portion having a distal end which bears against the lead-through tube in gas-tight relationship therewith. In addition, a tubular control electrode which coaxially surrounds the lead-through tube is preferably disposed within the sleeve so as to extend beyond the junction of the upper and lower sleeve portions. Further, the secondary coils advantageously are supported by the lead-through tube, which also constitutes a portion of the passage through which insulating gas is communicated to the high-pressure region of the transformer.

In accordance with the present invention, the high-pressure region, which essentially includes the interior of the top housing, is nowhere bounded by portions of the insulator. Rather, the high-pressure region is bounded exclusively by parts which, like the top housing, can be manufactured from metal or, alternatively, from an insulating material possessing a high mechanical strength. It is thus possible to increase the pressure of the insulating gas in the zones which are exposed to high voltages by a significant margin, compared to transformers of conventional design. The high dielectric strength thus obtained permits considerably higher voltages, while retaining the same outside dimensions, particularly with respect to the top housing.

These and other advantages of the present invention will be disclosed in or apparent from the following detailed description of a preferred embodiment.

BRIEF DESCRIPTION OF THE DRAWING

In the detailed description which follows, the preferred embodiment is described with references to the drawing, in which.

DETAILED DESCRIPTION OF THE PREFERRED EMBODIMENT

Figure 1:
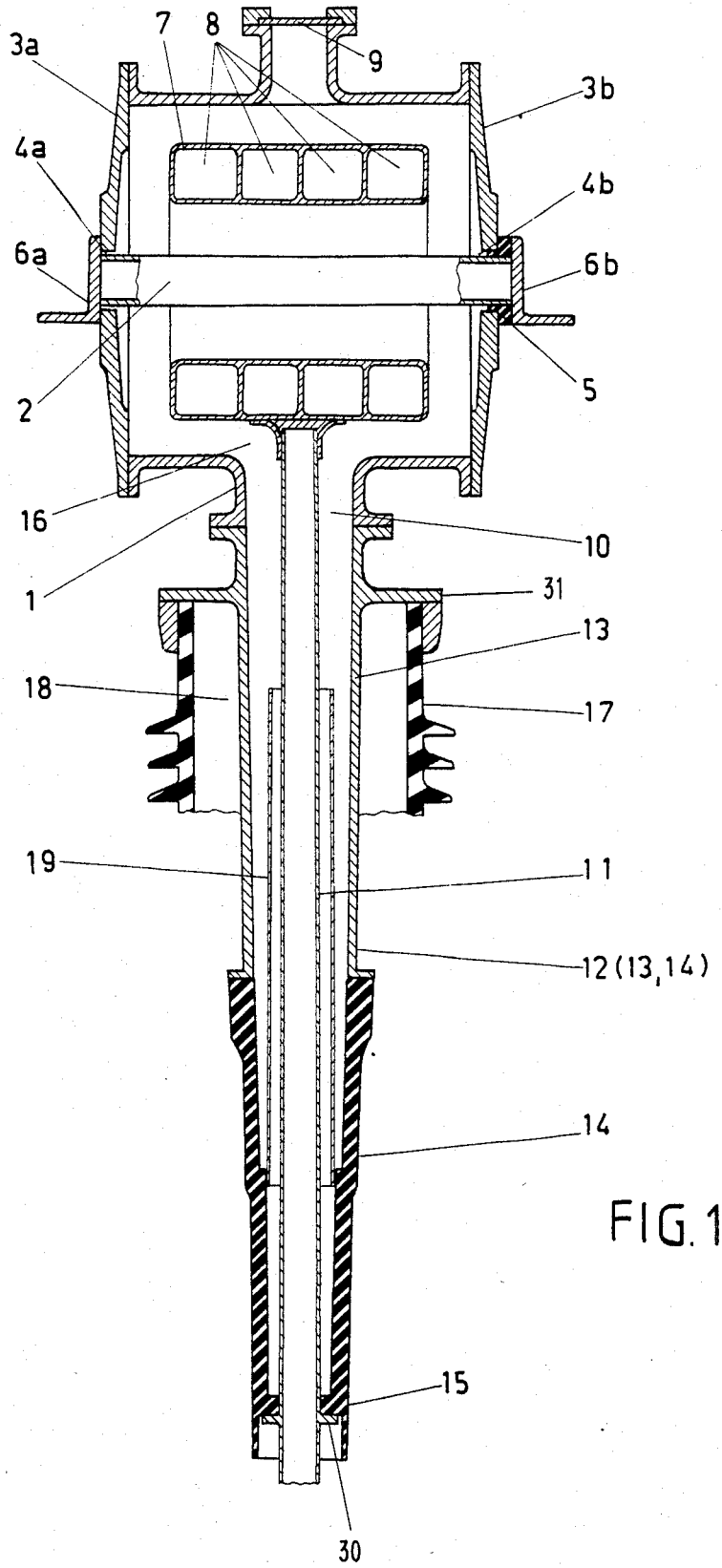
FIG. 1 is an axial cross-sectional view through the upper portion of a current transformer constructed in accordance with the present invention.

Referring to FIG. 1, the high-pressure region of the current transformer of the present invention comprises a cylindrical top housing 1 in which a primary conductor 2 is coaxially disposed. Housing 1 preferably is made of aluminum and is closed by two housing covers, 3*a* and 3*b*, which each possess central openings 4*a* and 4*b* that serve as lead-through openings for primary conductor 2. An insulating washer 5 isolates primary conductor 2 from housing cover 3*b*, and the ends of primary conductor 2 are connected to terminal elements 6*a* and 6*b*. Primary conductor 2 is surrounded by coils 8 of a secondary circuit, which coils are enclosed in a metal casing 7.

Top housing 1 also is formed with an upper opening which is closed by an excess-pressure safety device in the form of a frangible disk 9, and with a lower opening 10, through which passes a grounded lead-through tube 11 for the terminal leads of the secondary circuit. As is described hereinbelow, tube 11 also serves as the sole support for the coil assembly comprising coils 8 and casing 7. Tube 11 preferably is made of steel.

A composite sleeve 12 having an upper metallic portion 13 butt-jointed to a lower insulating portion 14 encloses a portion of tube 11. Upper portion 13 carries high-voltage and thus preferably is made of aluminum, like top housing 1, and advantageously constitutes an extension thereof. Lower portion 14 is preferably made of a high strength insulating material, such as casting resin. Upper portion 13 is joined to top housing 1 to form a continuous passage with lower opening 10. The lower, distal end 15 of sleeve portion 14 abuts tube 11 in a gas-tight manner and is supported thereby by a flange 30 containing a sealing ring (not shown) formed in tube 11. For electrostatic reasons, sleeve 12 advantageously tapers conically in a downward direction toward end 15. A cylindrical control electrode 19 is supported within sleeve 12 by lower portion 14 so as to coaxially surround lead-through tube 11 and ensure that the electric field is uniformly distributed in the region of the joint between upper portion 13 and lower portion 14 of sleeve 12.

Figure 2:
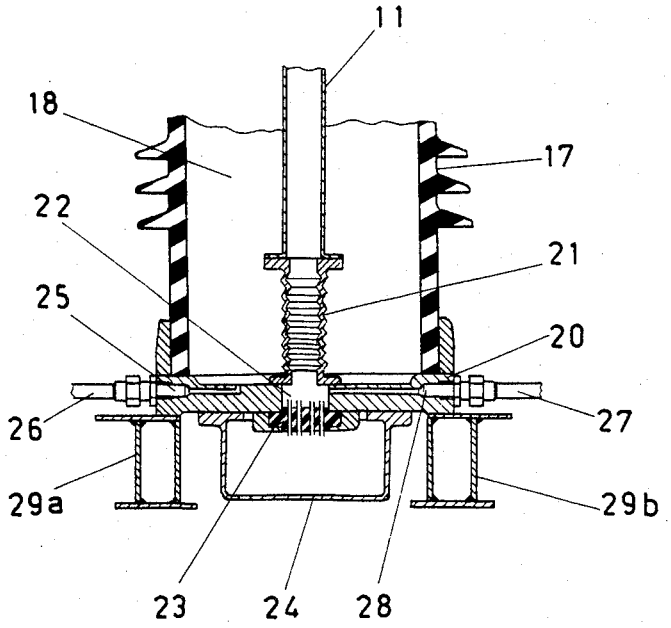
FIG. 2 is an axial cross-sectional view through the lower portion of the current transformer shown in FIG. 1.

A porcelain insulator 17 coaxially surrounds sleeve 12 and lead-through tube 11. As shown in FIG. 1, insulator 17 advantageously is joined in a gas-tight manner at its upper end proximate top housing 1 to a flange 31 extending from sleeve upper portion 13 at a location axially spaced from the joint of sleeve 12 with top housing 1. As shown in FIG. 2, insulator 17 is sealed at its lower, distal end by a base ring 20. Top housing 1 and sleeve 12 enclose a high-pressure region, generally denoted 16, for containing insulating gas such as sodium hexafluoride ($SF_6$) under a pressure of 350–600 kPa. The area between insulator 17 and sleeve 12, and, lower down, between insulator 17 and tube 11, constitutes a low-pressure region 18 for containing insulating gas at a pressure which insulator 17 can easily withstand, for instance, between 120 and 180 kPa.

It will be appreciated that by supporting the secondary coil assembly 7 and 8 solely with lead-through tube 11, which is in turn stabilized by the mounting arrangement at the lower end 15 of sleeve 12 described hereinabove, the need for post insulator supports on primary conductor 2 or on other elements carrying high voltage is eliminated. As a consequence, the danger that leakage currents could occur is minimized, which constitutes a further advantage of the construction of the present invention in addition to the improved pressurization capabilities.

Referring to FIG. 2, the lower portion of the current transformer of the present invention will now be described. Insulator 17 is mounted on base ring 20 in a gas-tight manner as described hereinabove and base ring 20 rests on supports **29*a* and 29*b*. A bellows-type compensator 21 is disposed between the lower end of lead-through tube 11 and base ring 20, and compensates for the dissimilarity in the thermal expansion characteristics of lead-through tube 11 and insulator 17. Base ring 20 is formed with an opening 22 which is sealed by means of a lead-through plate 23 composed of casting resin. Plate 23 contains cast-in conductors for connecting the secondary terminal-leads which are passed through lead-through tube 11 to a terminal box 24**.

A passage 25 connects a low-pressure gas supply line 26 to the low-pressure region 18. Lead-through tube 11 advantageously is used in order to connect the high-pressure region 16 (see FIG. 1) to a high-pressure gas supply line 27 in a particularly economical manner. The interior of lead-through tube 11 is connected to high-pressure gas supply line 27 via the interior of compensator 21 and a passage 28 in base ring 20.

It will be appreciated by those of ordinary skill in the art that the present invention is not restricted to the specific embodiment described hereinabove, and that changes and modifications in the preferred embodiment can be made without departing from the scope or spirit of the present invention.

We claim:

1. A current transformer comprising a metallic top housing containing a primary conductor surrounded by coil means of a secondary circuit; said top housing having a high voltage therein; hollow insulator means mounted on base means; said top housing being supported by said insulator means; tubular metallic lead-through means disposed within said insulator means and extending from said top housing to said base means for receiving terminal leads of said secondary circuit; and gas-tight partition means connected to said top housing for separating a high-pressure gas region encompassing said primary conductor and said coil means from a low-pressure gas region defined at least in part by said insulator means.

2. The current transformer of claim 1 wherein said partition means comprises a conical sleeve coaxially surrounding a portion of said lead-through means and extending into the interior of said insulator means.

3. The current transformer of claim 2 wherein said sleeve comprises a metallic upper portion and an insulating lower portion having a distal end which bears against said lead-through means in gas-tight relationship therewith, and said partition means further comprises tubular control electrode means disposed within said sleeve which coaxially surrounds said lead-through means and extends beyond the junction of said upper and lower sleeve portions.

4. The current transformer of claim 1 wherein said coil means is supported by said lead-through means.

5. The current transformer of claim 1 wherein said lead-through means constitutes a portion of the passage through which insulating gas is communicated to said high-pressure region.

* * * * *